US011123599B2

(12) United States Patent
Hundley

(10) Patent No.: US 11,123,599 B2
(45) Date of Patent: Sep. 21, 2021

(54) RUNNING EMULATOR

(71) Applicant: Kenn Hundley, Martinsville, VA (US)

(72) Inventor: Kenn Hundley, Martinsville, VA (US)

( * ) Notice: Subject to any disclaimer, the term of this patent is extended or adjusted under 35 U.S.C. 154(b) by 53 days.

(21) Appl. No.: 16/902,002

(22) Filed: Jun. 15, 2020

(65) Prior Publication Data

US 2020/0391074 A1 Dec. 17, 2020

Related U.S. Application Data

(60) Provisional application No. 62/921,360, filed on Jun. 14, 2019.

(51) Int. Cl.
*A63B 22/00* (2006.01)
*A63B 21/00* (2006.01)
(Continued)

(52) U.S. Cl.
CPC ..... *A63B 22/001* (2013.01); *A63B 21/00069* (2013.01); *A63B 21/0442* (2013.01);
(Continued)

(58) Field of Classification Search
CPC ..... A63B 22/001; A63B 22/0046; A63B 21/00069; A63B 21/0442; A63B 21/4011; A63B 23/03575; A63B 21/4017; A63B 22/00; A63B 22/0002; A63B 22/0007; A63B 22/0015; A63B 2022/0028; A63B 2022/0041; A63B 2022/0051; A63B 2022/0053; A63B 2022/0092; A63B 2022/0094; A63B 22/0012; A63B 23/03533; A63B 69/00; A63B 23/0417; A63B 23/0423; A63B 23/0429; A63B 2023/0441; A63B 2023/0447; A63B 2023/0452; A63B 23/0482; A63B 23/0211; A63B 23/1263; A63B 2022/003; A63B 2022/0038; A63B 2022/0043; A63B 2022/0647; A63B 22/0664; A63B 2022/067; A63B 2022/0676;
(Continued)

(56) References Cited

U.S. PATENT DOCUMENTS 4,940,233 A * 7/1990 Bull ..... A63B 21/154 482/112
5,279,529 A * 1/1994 Eschenbach ..... A63B 21/4049 482/51

(Continued)

*Primary Examiner* — Andrew S Lo
*Assistant Examiner* — Shila Jalalzadeh Abyaneh
(74) *Attorney, Agent, or Firm* — Robinson IP Law, PLLC

(57) ABSTRACT

A running emulator for increasing an athlete's strength in the movement of specific muscles used for running includes: a lower body frame; a pair of leg assemblies movably mounted on the lower body frame and having a leg extension carrier, a leg extension member slidably mounted through the leg extension carrier, a foot cradle mounted to the leg extension member; and two leg resistance members located on an outside of the lower body frame and connected to each of the pair of leg assemblies for resisting pivoting of the leg extension carrier relative to the lower body frame. During use by an athlete, the leg assemblies pivot and the leg extension member reciprocates through the leg extension carrier such that a path travelled by the athlete's foot on the foot cradle emulates motion of a sprinter.

9 Claims, 18 Drawing Sheets

(51) Int. Cl.
*A63B 23/035* (2006.01)
*A63B 21/04* (2006.01)

(52) U.S. Cl.
CPC ..... *A63B 21/4011* (2015.10); *A63B 21/4017* (2015.10); *A63B 22/0046* (2013.01); *A63B 23/03575* (2013.01)

(58) Field of Classification Search
CPC ..... A63B 2022/0682; A63B 22/14; A63B 2022/0688; A63B 23/035; A63B 23/03516; A63B 23/00; A63B 23/03541; A63B 23/03591; A63B 23/04; A63B 23/0405; A63B 23/0476; A63B 23/0494; A63B 23/1209; A63B 23/1245; A63B 23/1272; A63B 23/1281
See application file for complete search history.

(56) References Cited

U.S. PATENT DOCUMENTS 5,419,747 A * 5/1995 Piaget ..... A63B 22/001 434/255
5,496,235 A * 3/1996 Stevens ..... A63B 21/015 434/255
5,536,224 A * 7/1996 Hsieh ..... A63B 22/001 434/255
5,595,555 A * 1/1997 Chen ..... A63B 22/0056 434/255
5,605,521 A * 2/1997 Hsieh ..... A63B 22/001 434/255
5,613,924 A * 3/1997 Lee ..... A63B 21/055 434/255
5,624,354 A * 4/1997 Chen ..... A63B 22/001 434/255
5,643,141 A * 7/1997 Lee ..... A63B 21/055 482/123
5,655,998 A * 8/1997 Yu ..... A63B 22/0007 482/51
5,683,330 A * 11/1997 Kobayashi ..... A63B 22/06 482/51
5,792,028 A * 8/1998 Jarvie ..... A63B 22/001 482/51
5,910,072 A * 6/1999 Rawls ..... A63B 21/0053 482/51
6,010,429 A * 1/2000 Prueitt ..... A63B 5/20 482/4
6,036,622 A * 3/2000 Gordon ..... A63B 21/154 482/51
6,120,416 A * 9/2000 Walker ..... A63B 21/0023 482/51
6,183,397 B1 * 2/2001 Stearns ..... A63B 22/001 482/51
6,368,252 B1 * 4/2002 Stearns ..... A63B 22/0007 482/51
6,761,665 B2 * 7/2004 Nguyen ..... A63B 22/001 482/51
7,530,926 B2 * 5/2009 Rodgers, Jr. ..... A63B 22/001 482/51
7,645,215 B2 * 1/2010 Gordon ..... A63B 21/155 482/52
8,409,058 B2 * 4/2013 Gordon ..... A61H 1/0237 482/52
9,272,181 B2 * 3/2016 Arnold ..... A63B 22/0015
9,682,277 B2 * 6/2017 Gordon ..... A63B 22/001
2007/0197353 A1 * 8/2007 Hundley ..... A63B 69/0059 482/93
2015/0065304 A1 * 3/2015 Luger ..... A63B 22/0664 482/52
2016/0129301 A1 * 5/2016 Giannelli ..... A63B 21/4034 482/51
2017/0144016 A1 * 5/2017 Gordon ..... A63B 21/4034
2018/0008861 A1 * 1/2018 Abelbeck ..... A63B 23/0423

* cited by examiner

70

RUNNING EMULATOR

CROSS-REFERENCE TO RELATED APPLICATION

This application claims priority to and is a non-provisional of U.S. Provisional Patent Application Ser. No. 62/921,360 for a "Running Emulator" filed on Jun. 19, 2019, the contents of which are incorporated herein by reference in its entirety.

FIELD AND BACKGROUND

Embodiments of the present disclosure relate to strength training of all muscles used for running fast by athletes. The present disclosure relates to a movement specific, muscle specific, neuromuscular strength trainer. This technology engages and strengthens all of the muscles and connective tissue that are used for sprinting in the same sequence that would be used if you were running and it does this without having to make these muscles larger. This trainer is designed to force the runner to emulate the same motion that a sprinter uses when they are running fast. This training machine also emulates the direction of resistance on all of the muscles used for running and strengthens those exact muscles simultaneously while an athlete is working out on the trainer.

The Running Emulator is primarily targeted to be used by athletes that need to run short distances rapidly such as football players and track athletes. Football players lift heavy weights in a gym with their legs to make their muscles larger and stronger. Gym workouts are primarily designed to isolate one muscle group and make it larger. These workouts can be a combination of free weights and using selectorized machines that have a weight stack allowing selection of how much weight to use. Using either of these methods requires an athlete to make a muscle stronger by making the muscle larger. To make the muscles larger, the individual muscle must be worked out to the point that the muscle tears a little bit. If the muscles tears too much, an injury may result.

A lot of track sprinters do not perform any resistance strength training. Instead, they rely on their genetic gifts for speed. Some of these athletes do run on treadmills but they are running on these treadmills at the same speed that they would use if they were running on a track. This is dangerous on multiple levels and it does not provide any resistance other than the athlete's own body weight. The Running Emulator described herein may be used to make an athlete's movement specific running muscles and connective tissue stronger and this technology has as much of an effect on the athlete's nervous system as it does on the athlete's muscles. This is why it is called a neuromuscular strength trainer.

The workout on the Running Emulator makes an athlete run faster without having to isolate any one muscle group and make that muscle grow more mass. When a football player develops large thigh muscles, that player is having to carry the extra weight of those large muscles. This extra weight while running is counter-productive to gaining the advantage of speed. The fastest players on a football team are not the running backs, they are the defensive backs who usually weigh about 40 pounds less than the running back. Not having to carry that extra weight makes them faster.

The Running Emulator can make football players, track athletes and other athletes stronger and a higher strength level is usually evident after the first workout is done correctly. There are two different workouts that must be done separately on the Running Emulator system. There is a workout for the legs and lower body that requires the user to support their upper body weight, with their arms on an arm rest, while working out the lower body and a work out for the arms and upper body that can be performed while standing up.

SUMMARY

There are three possible machine frames described in this application that can be used for these two workouts. For this application, the term "combo frame" is used for both the legs and arms workout, the term "leg frame" is used for the legs workout only and the term "arm frame" is used for the arms and upper body workout. The combo frame is primarily used for a small number of runners and for demo purposes. The independent leg frame and the arm frames are used where that is a larger quantity of runners that all need to use the machine in the same day.

When you work out on the Running Emulator, you are reducing the possibility of injuring yourself by about 90%. This is because you are using at least 30 different muscles for the leg workout sequentially and simultaneously in each full leg movement and 20 different muscles for the full arm movement. The Running Emulator uses resistance that is much lower than lifting weights. By using so many muscles at the same time, you are spreading this resistance over a larger number of muscles. This, along with using lower resistance is what eliminates possible injuries to the running muscles.

The resistance used for the leg and arm workouts is created by nitrogen gas cylinders. There are two independent gas cylinders used for each arm and each leg. There is a gas cylinder used for the forward movement of each arm and each leg and there is a different gas cylinder used for the backward movement of each arm and each leg. The amount of resistance on any gas cylinder is adjustable. When performing the leg work out, an athlete is working out all the running muscles from the top of the abdomen to the toes, at the same time. When performing the arm workout, the athlete is working out the rest of the muscles in the upper body that are used for running, at the same time.

There is also a tangible benefit to working out so many muscles simultaneously. Gym equipment is designed to work out only large muscles groups. Half of the total number of muscles used to run, are small and gym equipment is not designed to work these muscles out at all. As a result of these small muscles not getting worked out, they are not recruited and used proportionately. When working out on the Running Emulator, these small muscles are recruited and they are strengthened at the same time. This results in the large muscles not having to work as hard, is that they are not relied on as much to take all of the load for making the body move forward at faster speeds. This workout also pre-habilitates all the running muscles, and this helps to prevent the large muscles and connective tissue from being injured in training and from running itself.

The runner's brain and nervous system are also affected by this workout. When a runner starts to run, they are forcing the brain to send higher electrical impulses from the brain to the running muscles, than are used to walk. It does not make any difference how fast the runner is trying to run, from the brain's perspective, it is going to give all of those running muscles, a finite amount of electrical impulses. Those level of impulses are determined on how effective the runner is at training those running muscles to get a safe level of impulses without damaging the muscles.

When you work out on the Running Emulator, the movement specific resistance that all the running muscles receive, forces the brain to send higher electrical impulses to all of the specific muscles that are being worked out simultaneously. This workout raises and resets the level of electrical impulses to all of the running muscles. This new level of impulses is also stored in motor memory. This higher level of movement specific resistance is how the motor memory learning switch is activated but this is not all that is changed and stored in motor memory.

When the runner gets off the emulator, they will feel their muscles using this additional level of impulses and the runner will feel a different level of strength from having the small muscles worked out immediately. The result is that the runner gets stronger and faster immediately, without having to strain the muscles and without having to grow more muscle mass. Because the runner is recruiting the smaller muscles and giving them resistance that they have never had, the runner must gradually train these smaller muscles to get strong enough to be proportionately as strong as the larger muscles. This means that in the beginning of workouts, an additional burst of strength from the larger muscles may not be felt. It is only when the small and large muscles are working out at the same proportionate level, that the large muscles get enough impulses to work beyond what they usually work when running. The beginning workouts, are going to give the large muscles a little more resistance that normal but the same workout will give the small muscle a larger amount of resistance proportionately.

The Running Emulator forces the user to emulate a specific running movement and pattern that is restrictive in that is forces the user to have better running form. The Emulator forces the user to move their feet and hands on a single plane forward and backward. This design does not allow the user to move their feet inside or outside of this plane. This makes the running movement more energy efficient and allows the runner to run faster. This does not just affect the user while on the trainer. This also affects form when are running.

The additional resistance turns on the motor memory switch but everything that the athlete is doing while that switch is on, is going into motor memory. This motor memory storage includes storing the process of recruiting the smaller muscles used to run that cannot be worked out by lifting weights, a higher level of electrical impulses to all of the muscles used to run and the more efficient running form that the trainer forces the user to emulate while they are working out on the trainer. By storing all of this in motor memory, the athlete does not have to think about their form when they are running. The consequence of working out and strengthening all of the muscles in the same movement specific manner that they are used in when you run, creates a type of continuity that helps to synchronize the sequential firing of all of the muscles that are used to run. This effect cannot be experienced by working out each muscle independently.

Therefore, it is the object of the invention to provide neuromuscular strength training with adjustable resistance to all of the movement specific muscles used for running.

It is a further object of the invention to provide components that are adjustable to all of the athlete's specific body dimensions.

It is a further object of the invention to provide training machines that strengthens all of the muscles used for running in the lower body with a separate work out that strengthens all the muscles in the upper body.

It is a further object of the invention to provide a training machine that forces the user to maintain efficient form on a single plane with the feet and arms while training and while running.

It is a further object of the invention to provide strength training for the movement specific muscles while simultaneously and substantially, reducing the possibility of injury to the athlete while training and while running.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

The present invention relates to a muscle strengthening apparatus designed to exercise and strengthen the movement specific muscles used for running in sports. The Running Emulator is designed to work out these movement specific muscles in two independent processes. There is a workout designed to engage and strengthen the lower body muscles used for running and a work out designed to strengthen the upper body muscles used for running. For a commercial use of the running emulator, two different machines will be used to allow more athletes to train at the same time. The leg frame is used for the lower body work outs and the arm frame is used for the upper body workouts. For smaller group of users and for demonstration purposes, a frame that incorporates all the parts needed to perform both work outs is called the combo frame. All three of these frames are described in FIGS. 1, 2 and 16.

Figure 1:
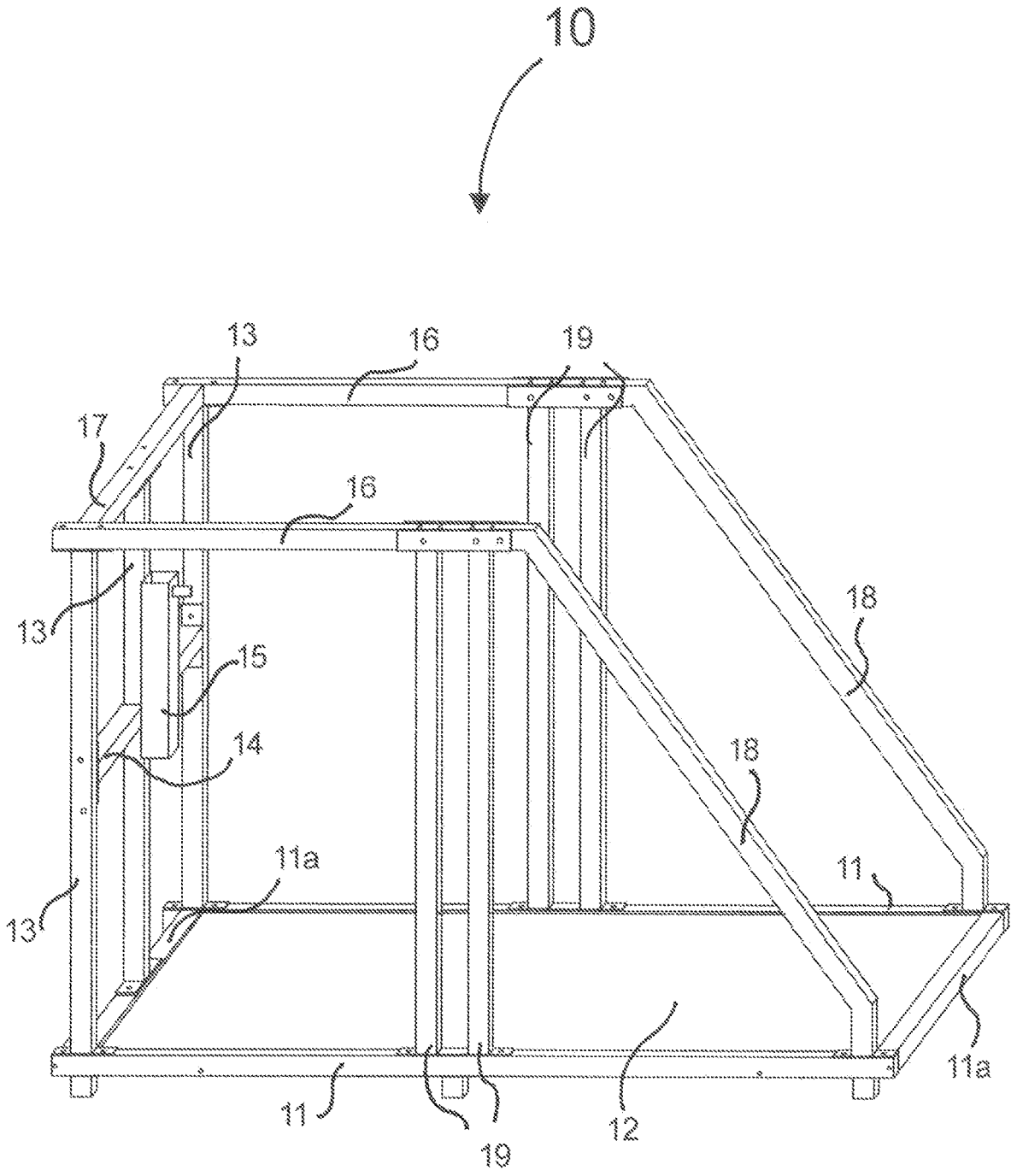
FIG. 1 is a perspective view of the leg frame only according to one embodiment of the present disclosure.

The leg frame is show in FIG. 1 at reference numeral 10. The front of the frame is on the left side. The leg frame 10 includes side base rails 11, end base rails 11 *a*, a platform 12 positioned inside and parallel to the top of the base rails, three front uprights 13 attached to and extending upward from the base rails, a front middle cross support 14 extending laterally in between the front uprights 13, a front top cross support 17 attached to the top of the front uprights, an arm rest adjustment sled 15 attached vertically to the middle front upright. The two opposing top rails 16 are attached to the front top cross support in the front and attached to the two sets of opposing dual uprights 19 in the center of the frame. The rear angle supports 18 are attached to the top of the dual uprights 19 and to the base rails 11 at the bottom rear.

Figure 2:
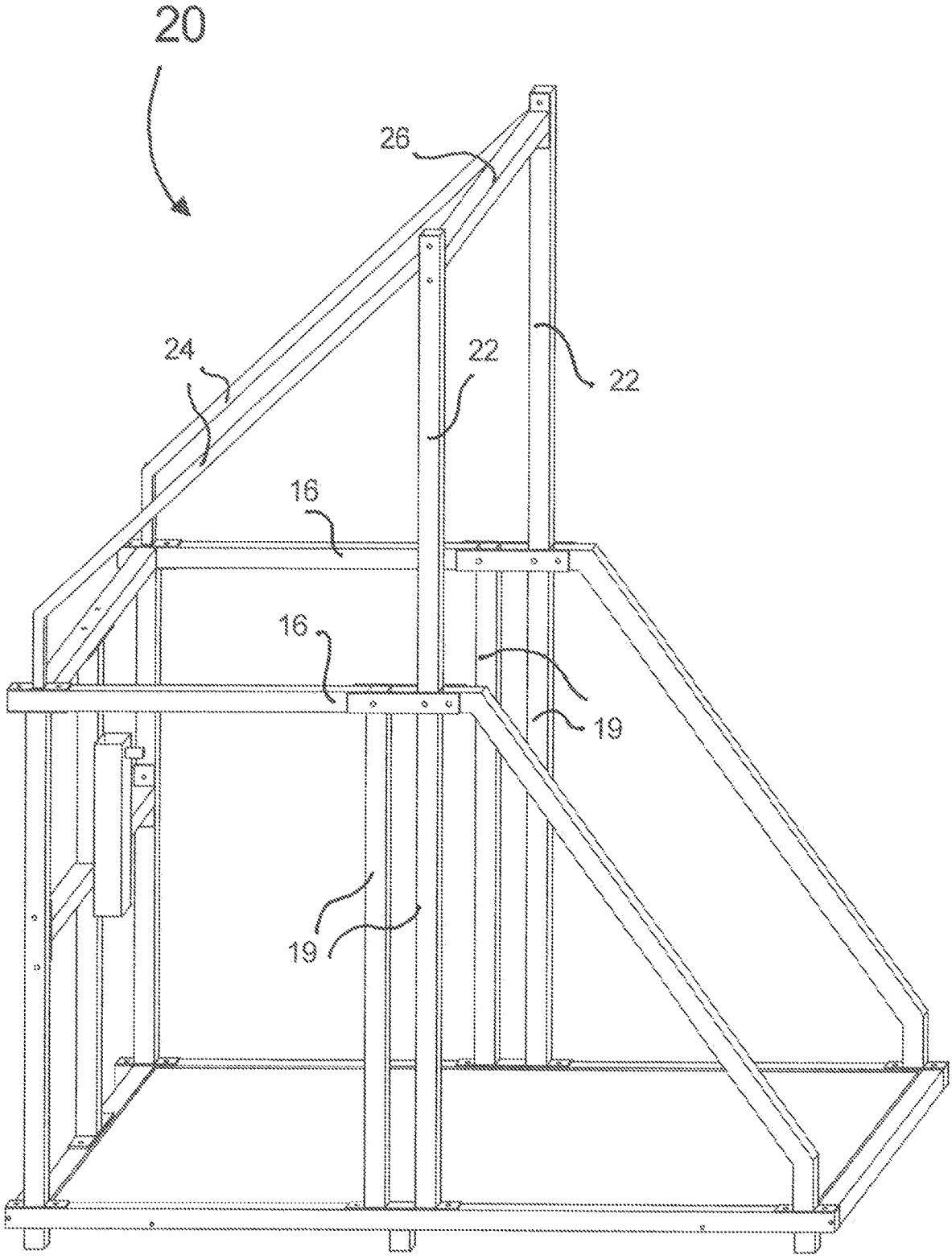
FIG. 2 is a perspective view of the combo frame without any assemblies according to one embodiment of the present disclosure.

As shown in FIG. 2, the combo frame referenced as 20 has all of the same components referenced in FIG. 1 leg frame 10 in addition to opposing arm adjustment uprights 22 mounted inside and on top of the dual uprights 19. The arm frame cross support 26 connects laterally to the top of the arm adjustment uprights 22. The front top angle supports 24 connect to the top of the arm adjustments uprights 22 and on the lower end are attached to the top rails 16.

Figure 3:
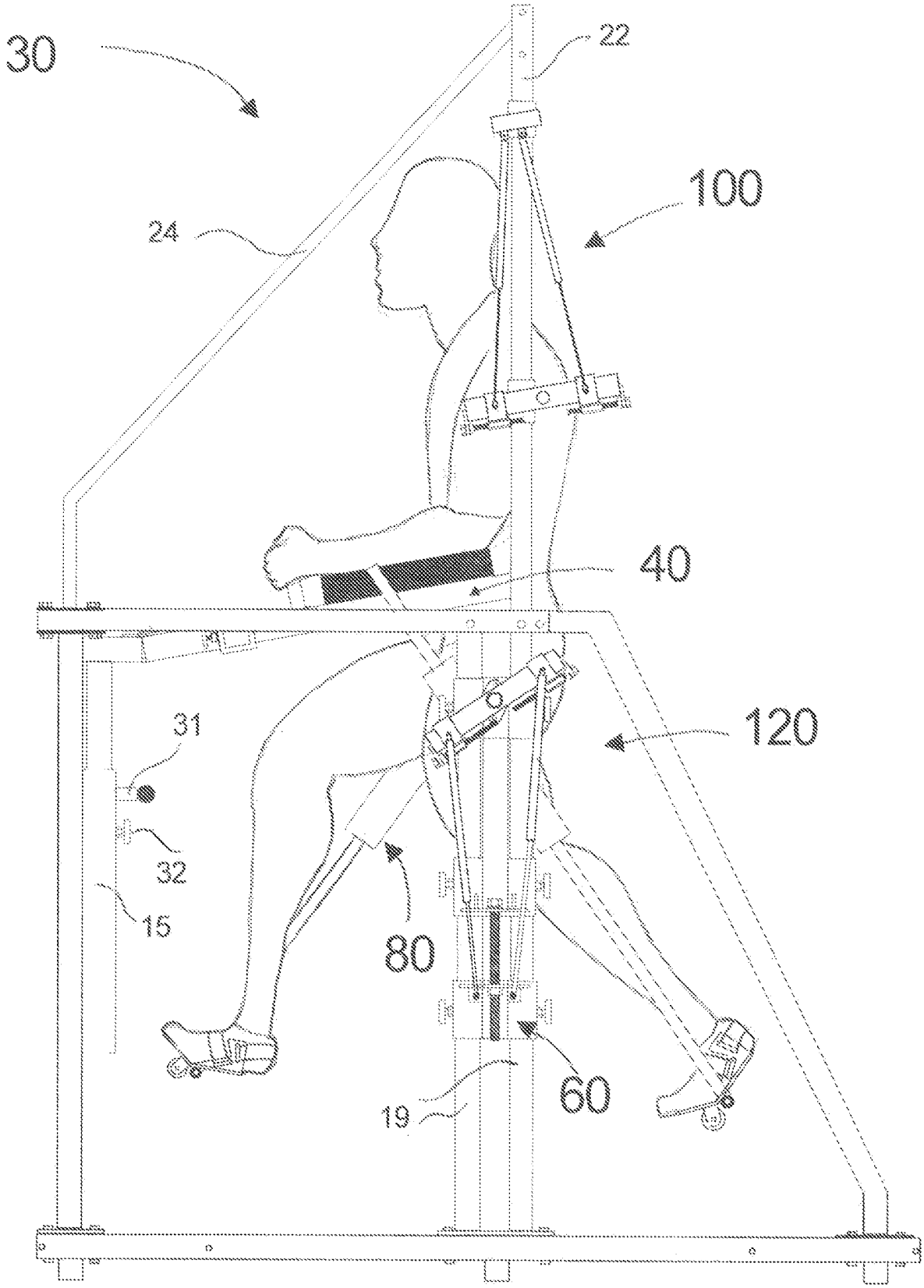
FIG. 3 is a side elevation of the combo frame with all assemblies and the runner according to one embodiment of the present disclosure.

FIG. 3 is the combo frame referenced as 30 with the arm rest assembly 40 mounted inside the arm rest adjustment sled 15 and its height is adjusted with pop pin 31 and the torque bolt 32 tightens and removes the slack after adjustment. A leg resistance assembly 120 which provides the resistance for leg work out, is slidably mounted onto both sides of the frame on the outside of the dual uprights 19 and houses multiple assemblies including the cylinder range assembly 60. On the inside of both sides of the frame, and rotatably mounted to an axle of the leg resistance assembly 120, is the leg workout assembly 80. The leg resistance assemblies 120 are slidably adjusted for their height on the dual uprights 19. This adjustment feature allows the axle of the leg resistance assembly 120 to adjust to the height of the athlete's hip joint where it attaches to the femur. More details of this assembly are revealed in FIGS. 7, 8 and 9. The arm resistance assembly 100 is also mounted in a similar fashion to opposing arm adjustment uprights 22 which is supported by front top angle supports 24.

Figure 4:
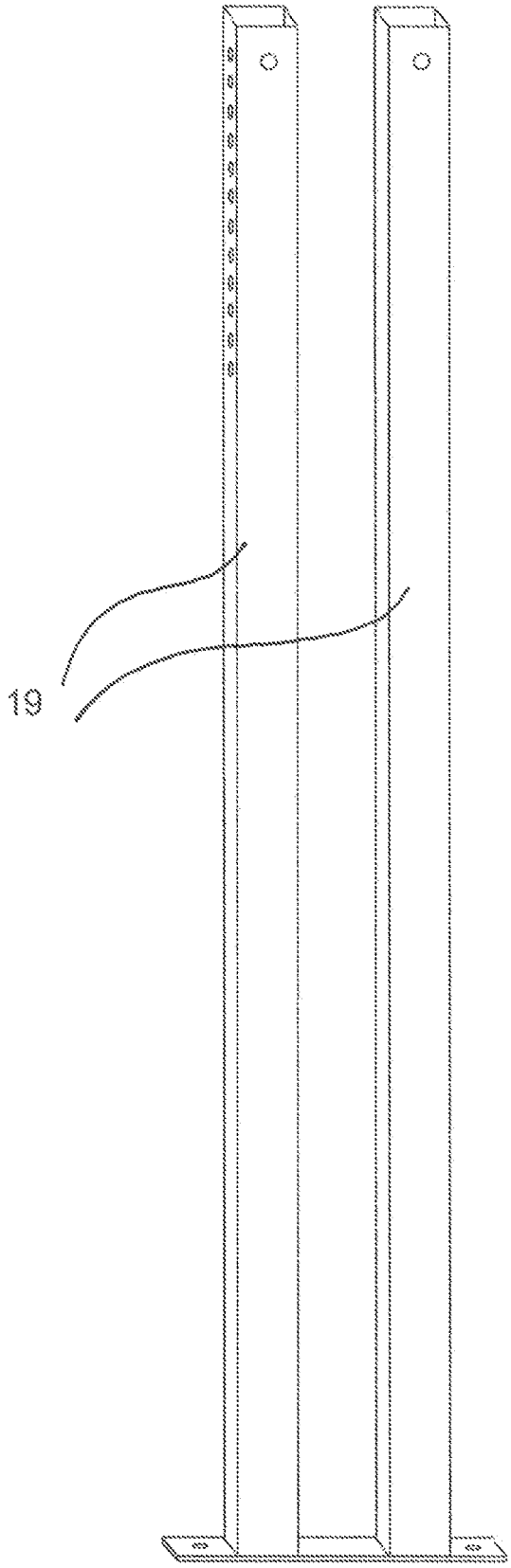
FIG. 4 is a perspective view of the dual uprights according to one embodiment of the present disclosure.

FIG. 4 shows the dual uprights 19 mounted on both sides of the base rail 11 in FIG. 1. These square tubes are essential to prevent the twisting of the leg resistance assemblies 120 and the leg workout assemblies featured in FIG. 3 when the runner is moving their feet backward and forward. These square tubes feature a series of holes positioned vertically at the top of the front upright only. These holes provide height adjustment for the leg assemblies 120 and 80.

Figure 5:
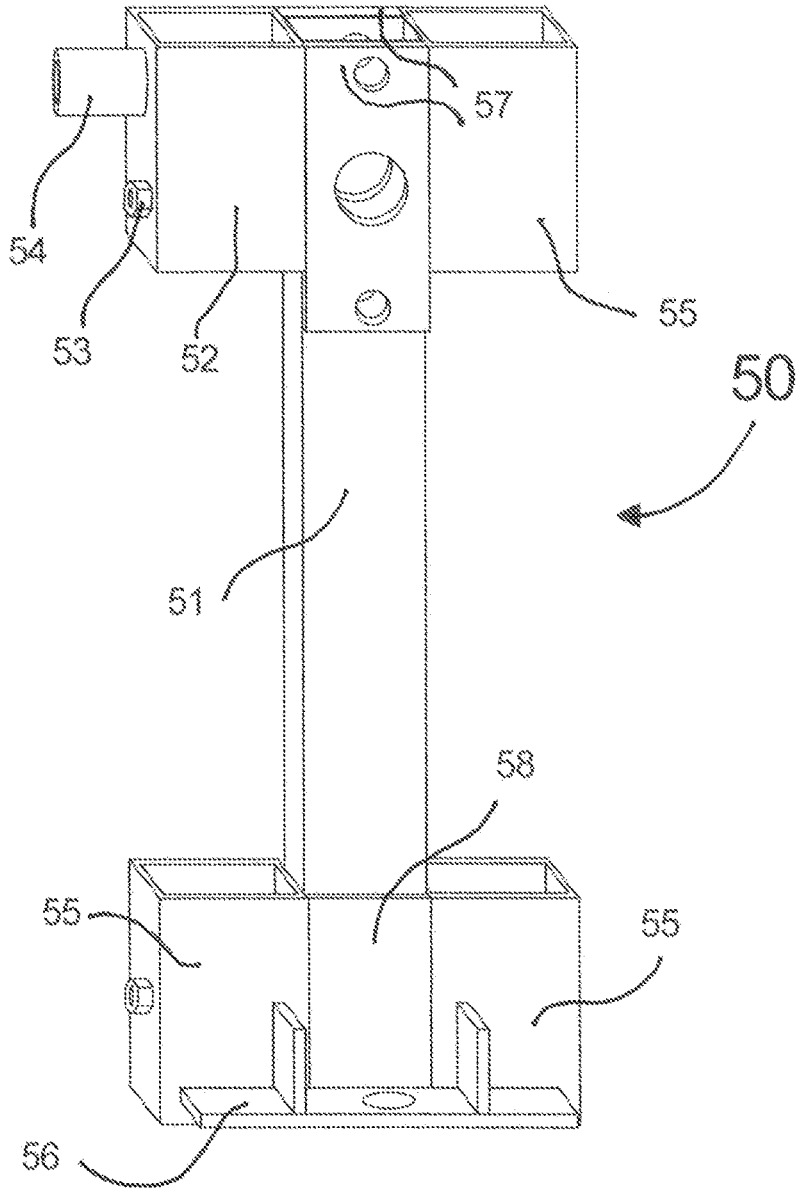
FIG. 5 is a perspective view of the leg adjustment sled assembly without an attachments according to one embodiment of the present disclosure.
Figure 6:
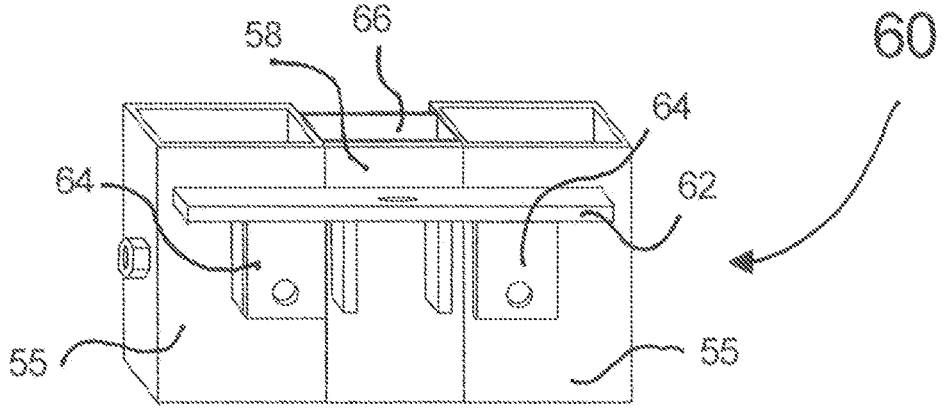
FIG. 6 is a perspective view of the cylinder range assembly without any attachments according to one embodiment of the present disclosure.

As shown in FIG. 5 the leg adjustment sled assembly 50 shows series of components permanently affixed to the leg adjustment sled support 51 including the ball bearing mounting plates 57 attached to both sides of the leg adjustment sled support 51, the pop pin adjustment sled 52 with the pop pin housing 54 and torque nut 53, three upright adjustment sleds 55 are attached to the leg adjustment sled support 51 which have a torque nut 53 attached, the sled support spacer plate 58 is mounted between the upright adjustment sleds 55 on assembly 50 and assembly 60, the acme bolt plate support 56 is attached to the bottom two upright adjustment sleds 55. The leg adjustment sled assembly 50 is slidably mounted on the dual uprights 19 shown in FIG. 4. In FIG. 6 the cylinder range assembly 60 features two upright adjustment sleds 55 which are mounted on either side of the adjustment sled spacer tube 66, the acme nut plate support 62 and the gas cylinder attachment plates 64 are attached to the upright adjustment sleds 55. The cylinder range assembly 60 is slidably mounted onto the dual uprights 19 shown in FIG. 4, under the leg adjustment assembly 50.

Figure 7:
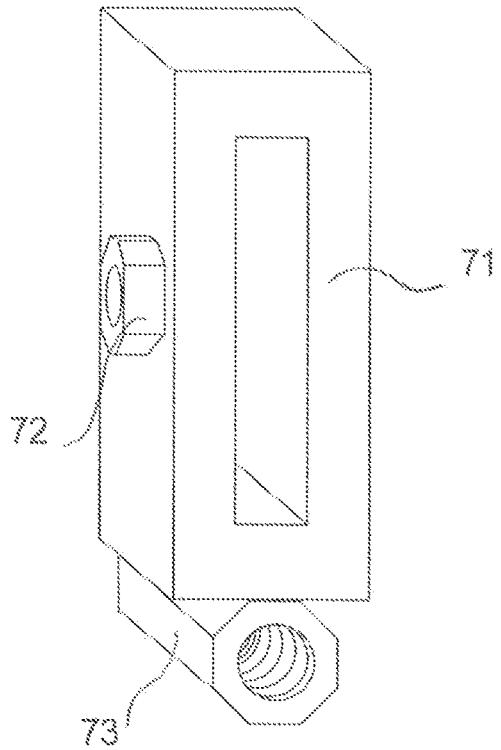
FIG. 7 is a perspective of the adjustment slide according to one embodiment of the present disclosure.

FIG. 7 shows the adjustment slide 71 with a gas cylinder attachment nut 72 affixed to the front side and a resistance adjustment coupling 73 attached to the bottom. The axle plate assembly 70 in FIG. 8 includes two adjustment slides 71 which are slidably mounted onto the axle plate 75 in FIG. 8. Permanently affixed to the axle plate 75 is the leg axle 74 and the adjustment bolt support plates 78. The resistance adjustment bolts 77 protrude through the adjustment bolt supports plates 78 and are rotatably mounted to the resistance adjustment bolt couplings 73 from opposing ends of the axle plate 75. Adjustment bolt stops 79 are permanently affixed to the resistance adjustment bolts 77 on the inside of the adjustment bolt supports plates 78. These stops allow the resistance adjustment bolts 77 to rotate and move the resistance adjustment bolt couplings 73 laterally, while keeping the resistance adjustment bolts 77 stationary.

Figure 9:
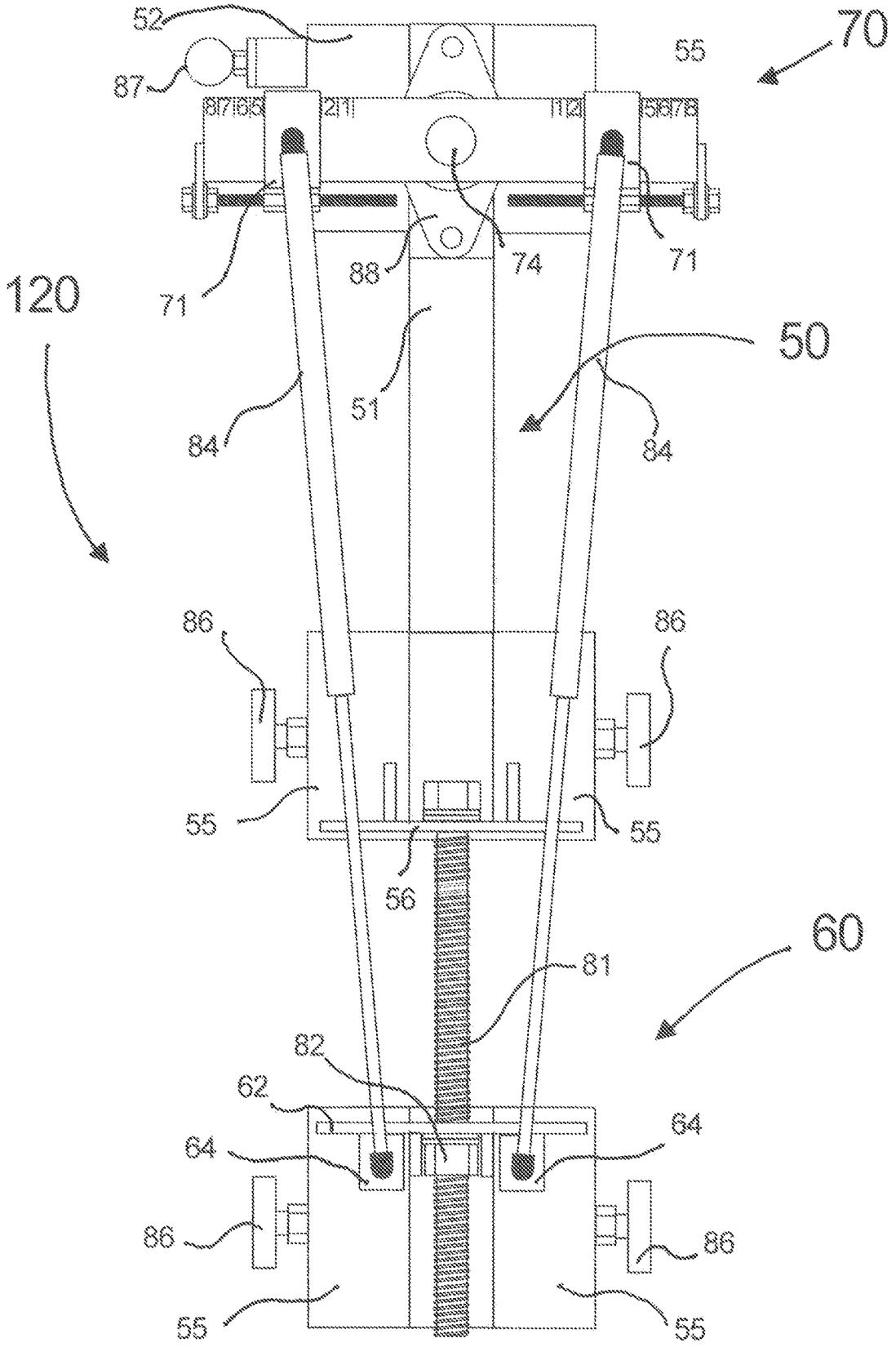
FIG. 9 is a side elevation view of the fully assembled leg resistance assembly according to one embodiment of the present disclosure.
Figure 14:
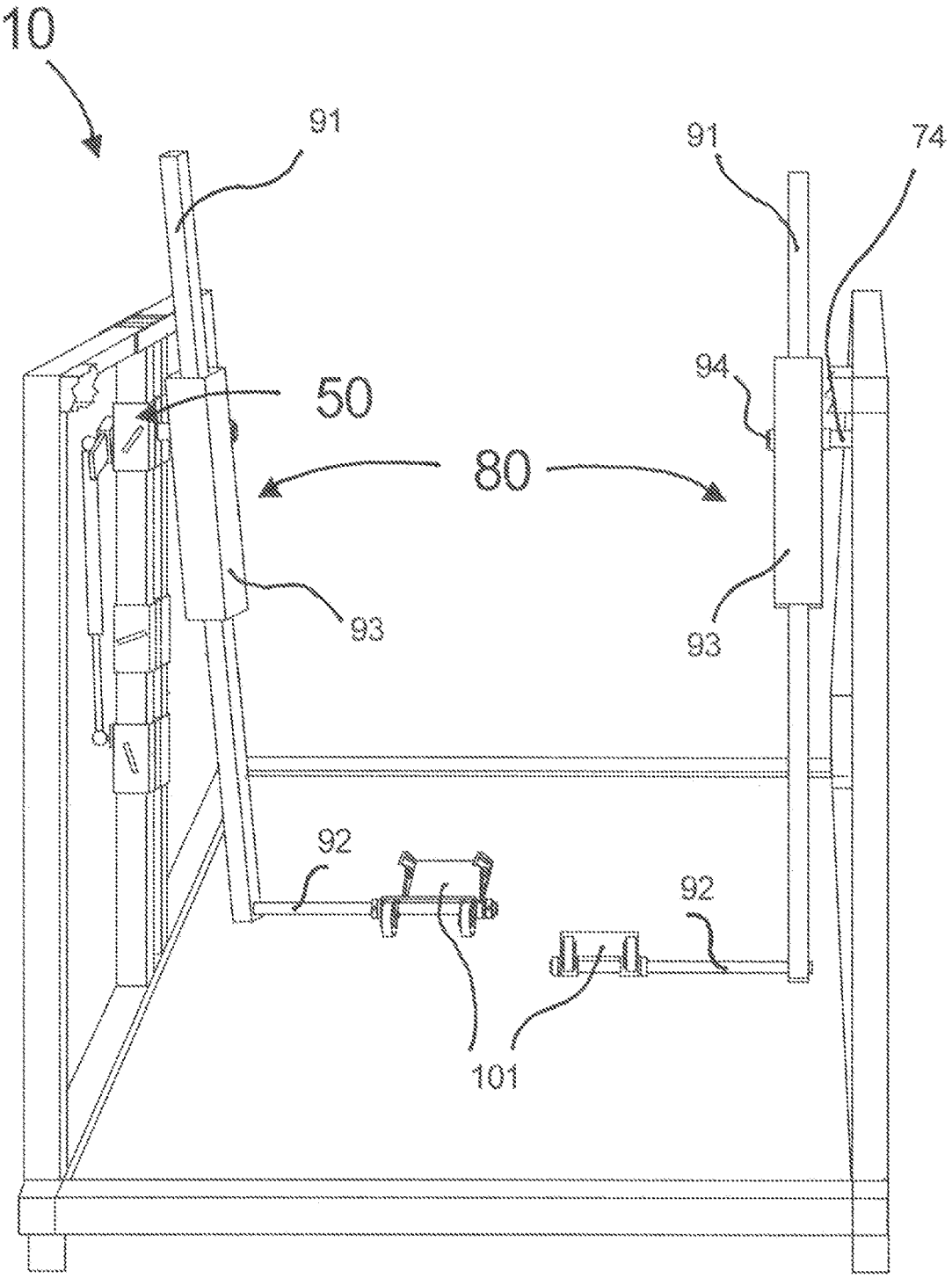
FIG. 14 is a perspective view from the front of the combo frame featuring the leg workout assemblies according to one embodiment of the present disclosure.

FIG. 9 shows the left side leg adjustment sled assembly 50 with pillow block bearings 88 which are attached to the front and back side of the leg adjustment sled support 51. A pop pin 87 is attached to the pop pin adjustment sled 52. The leg axle 74 from the axle plate assembly 70, is inserted through both of the pillow block bearings 88 and eventually attaches to leg workout assembly 80 on the inside of the dual uprights 19 as seen in FIG. 14. The acme bolt 81 protrudes through the acme bolt plate support 56, it then goes down through the acme nut plate support 62 on the cylinder range assembly 60 and it is rotatably mounted to the acme nut 82. Torque bolts 86 are rotatably mounted into the nuts on the outside of all of the upright adjustment sleds 55. The nitrogen gas cylinders 84 are attached at the top to the two adjustment slides 71 and attached at the bottom to the gas cylinder attachment plates 64. The leg resistance assembly 120 is linked to the leg workout assembly 80 seen in FIG. 14 through the leg axle 74. When the runner attaches their foot to the leg workout assembly and moves it back and forward, it rotates the axle plate 75 and this motion compresses the gas cylinder rod in the gas cylinders 84 and this compression provides the resistance for the running movement in the legs. After all three of these assemblies 50, 60, 70 have been put together, the make up the total components of the leg resistance assembly 120. This complete assembly is then slidably mounted on the dual uprights 19 in FIG. 4.

Figure 8:
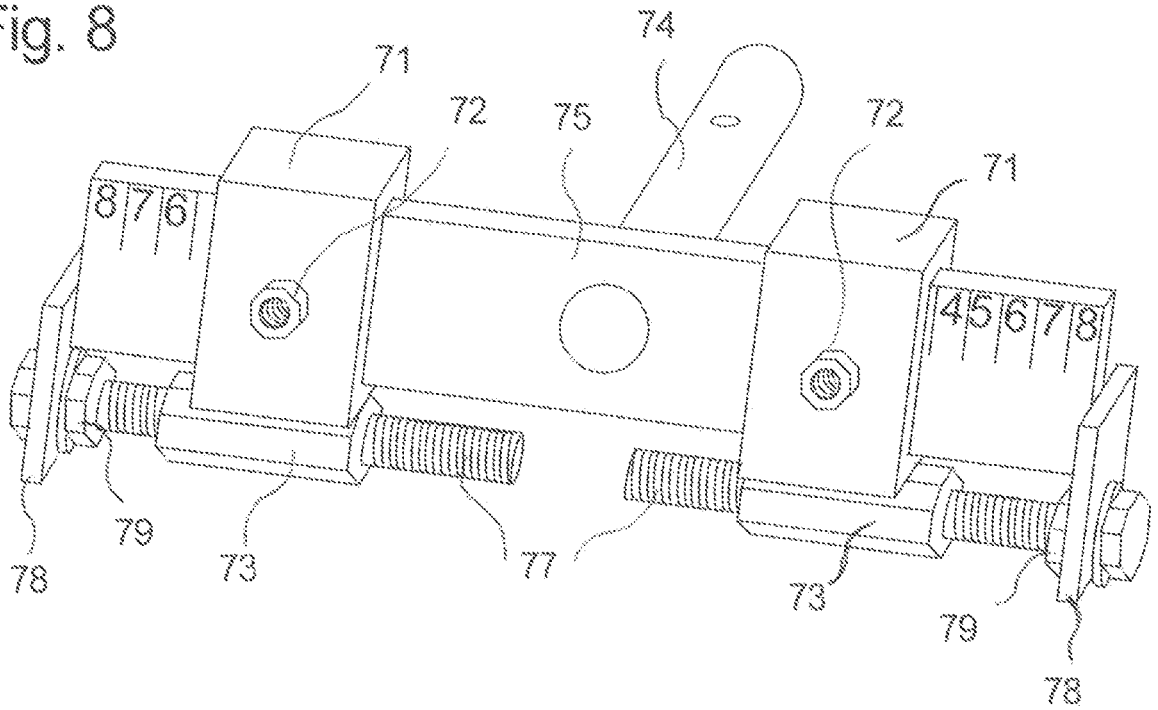
FIG. 8 is a perspective view of the axle plate assembly according to one embodiment of the present disclosure.
Figure 10:
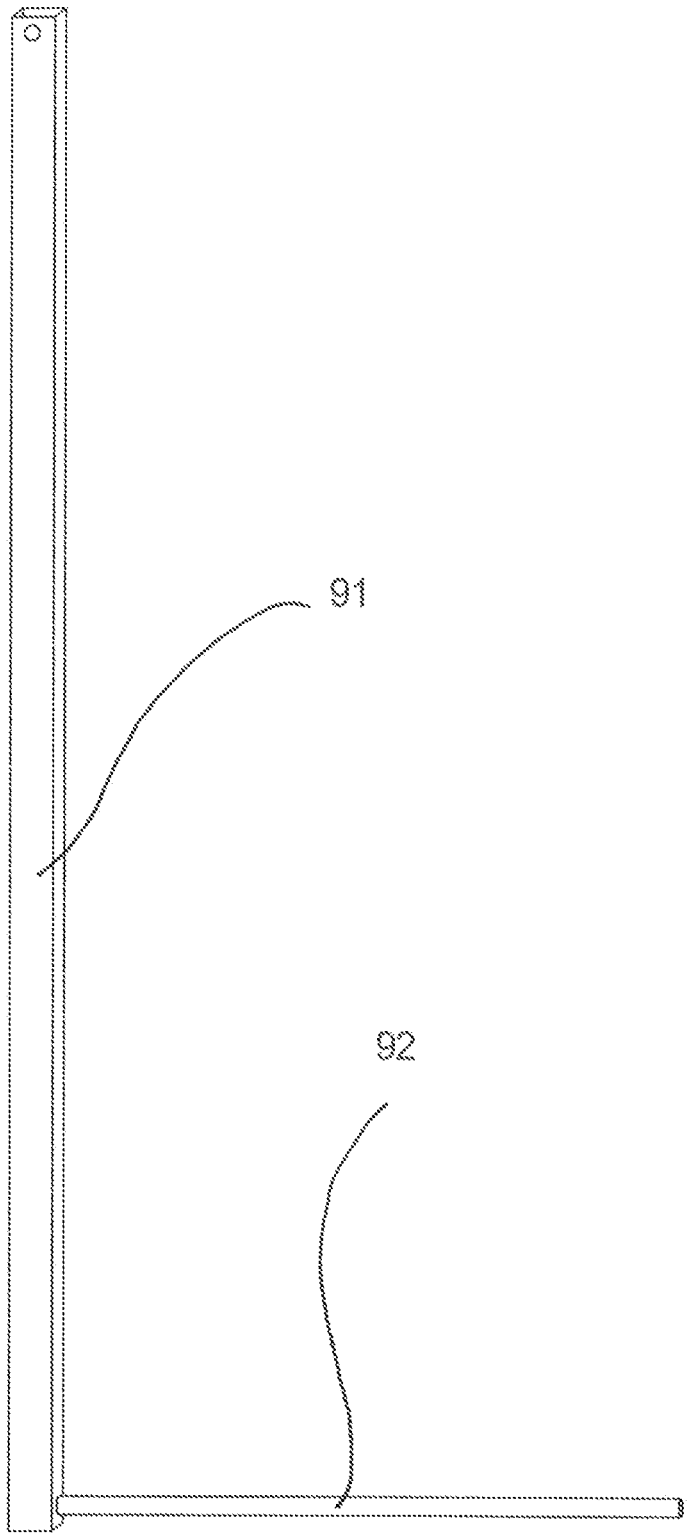
FIG. 10 is a perspective view of the leg extension tube and leg extension rod according to one embodiment of the present disclosure.
Figure 11:
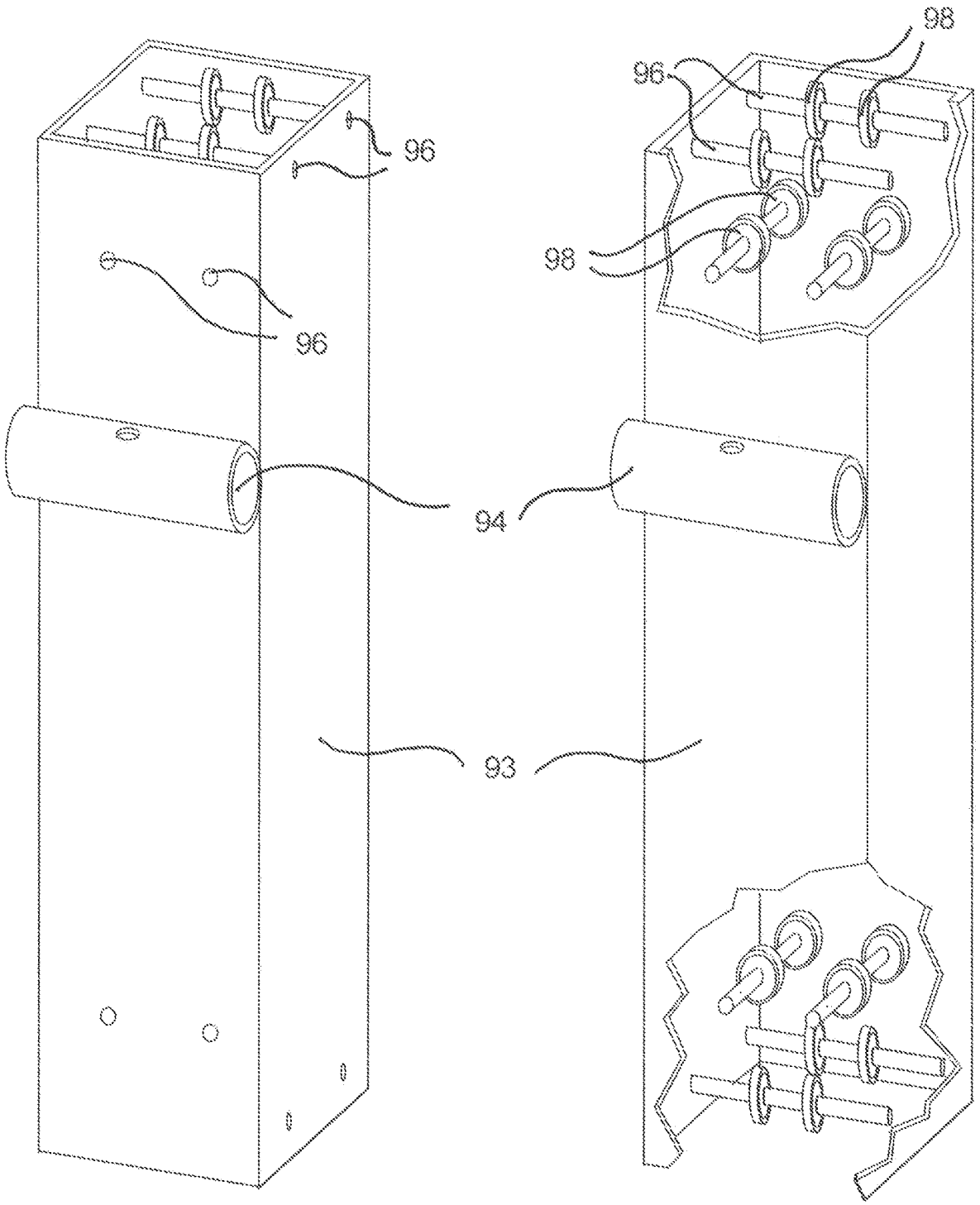
FIG. 11 is a perspective view of the leg extension carrier with and additional perspective view of a cut a way view of the top and bottom portion of the carrier according to one embodiment of the present disclosure.

FIG. 10 represents the leg extension tube 91 and attached to it is the leg extension tube rod 92. FIG. 11 represents a perspective view of the leg extension carrier 93 in two drawings. The second drawing shows a cut a way view of the top and bottom portions of the inside of 93 revealing the series of multiple pairs of ball bearings 98 and the ball bearing support rods 96. The leg bearing axle housing 94 is permanently attached to the leg extension carrier 93 and will eventually slide onto the end of the leg axle 74 from the axle plate assembly 70 and attach to the axle as seen in FIG. 8. Internally mounted inside the leg bearing housing at the top and bottom are a series of ball bearings 98 affixed to ball bearing support rods 96, the ball bearings are permanently positioned so that two ball bearings in the top and bottom of the leg extension carrier 93, mounted on the ball bearing rod 98, touch each side of the leg extension tube 91 from FIG. 10. When the leg extension tube 91 it is inserted into the leg extension carrier 93, the arrangement of the ball bearings prevent the leg extension tube from twisting when being used.

Figure 12:
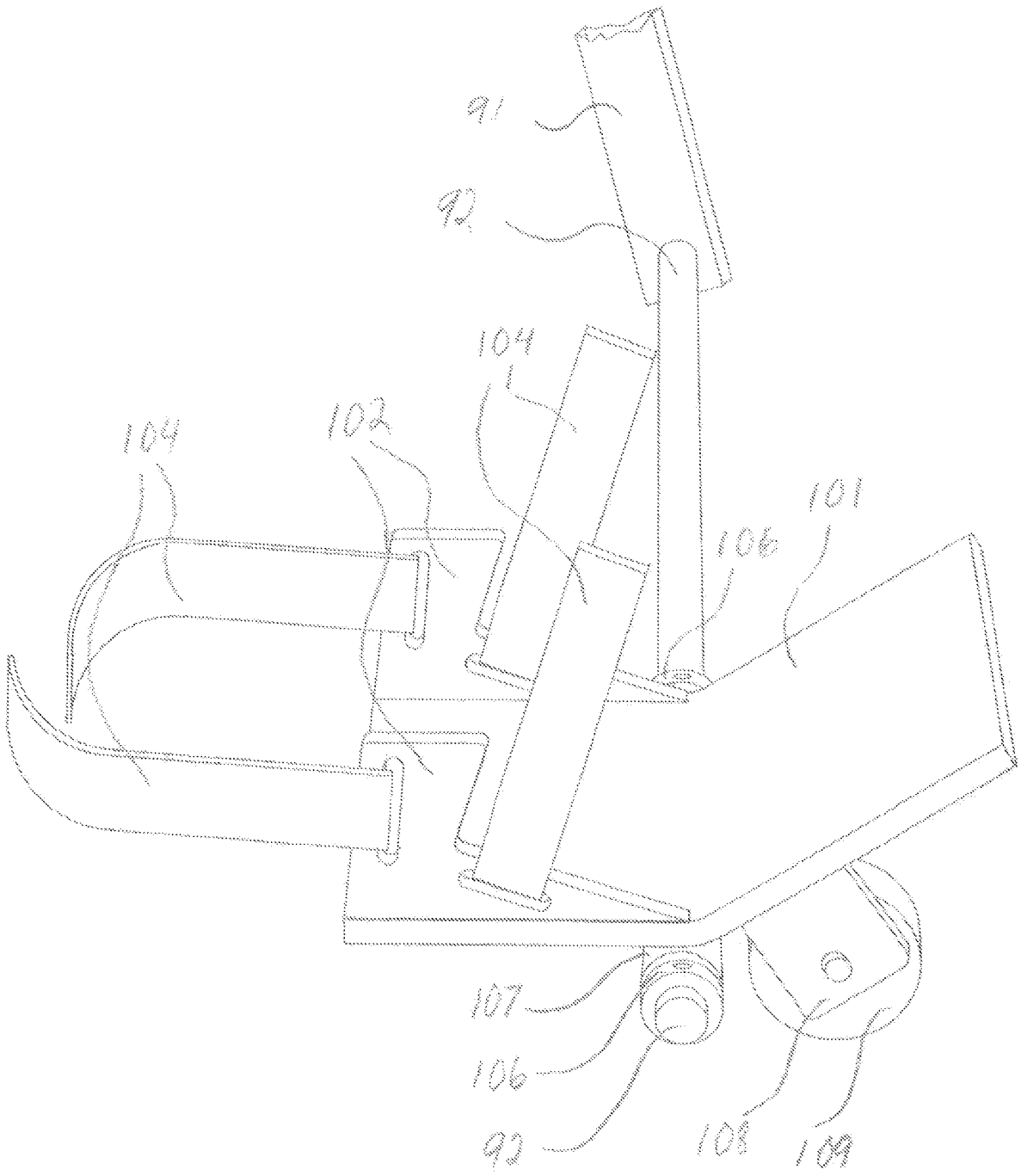
FIG. 12 is a perspective view of the foot cradle assembly according to one embodiment of the present disclosure.

FIG. 12 reveals the foot cradle assembly that is used to attach the runner's left foot. The toe of the runner goes on the right side of the foot cradle plate 101 and the heel of the runner goes on the left side where the foot adjustment straps 104 are located. The adjustment straps 104 use Velcro to attached to each other and are attached to the opposing foot cradle strap housings 102. There is a plurality of foot cradle wheels 109, one wheel for each side of the plate 101, mounted in between the foot cradle wheel plates 108. Permanently attached to the bottom and on each side of the foot cradle plate 101 are the two axle rod housings 107 which house a lubricated leg extension rod 92 which is attached to the leg extension tube 91. On both sides of the cradle, mounted on the leg extension rod 92, are two adjustment collars 106 which employ a set screw that allows the foot cradle to move to different positions on the leg extension rod 92 to accommodate a wider or narrower stance depending on the size of the runner.

Figure 13:
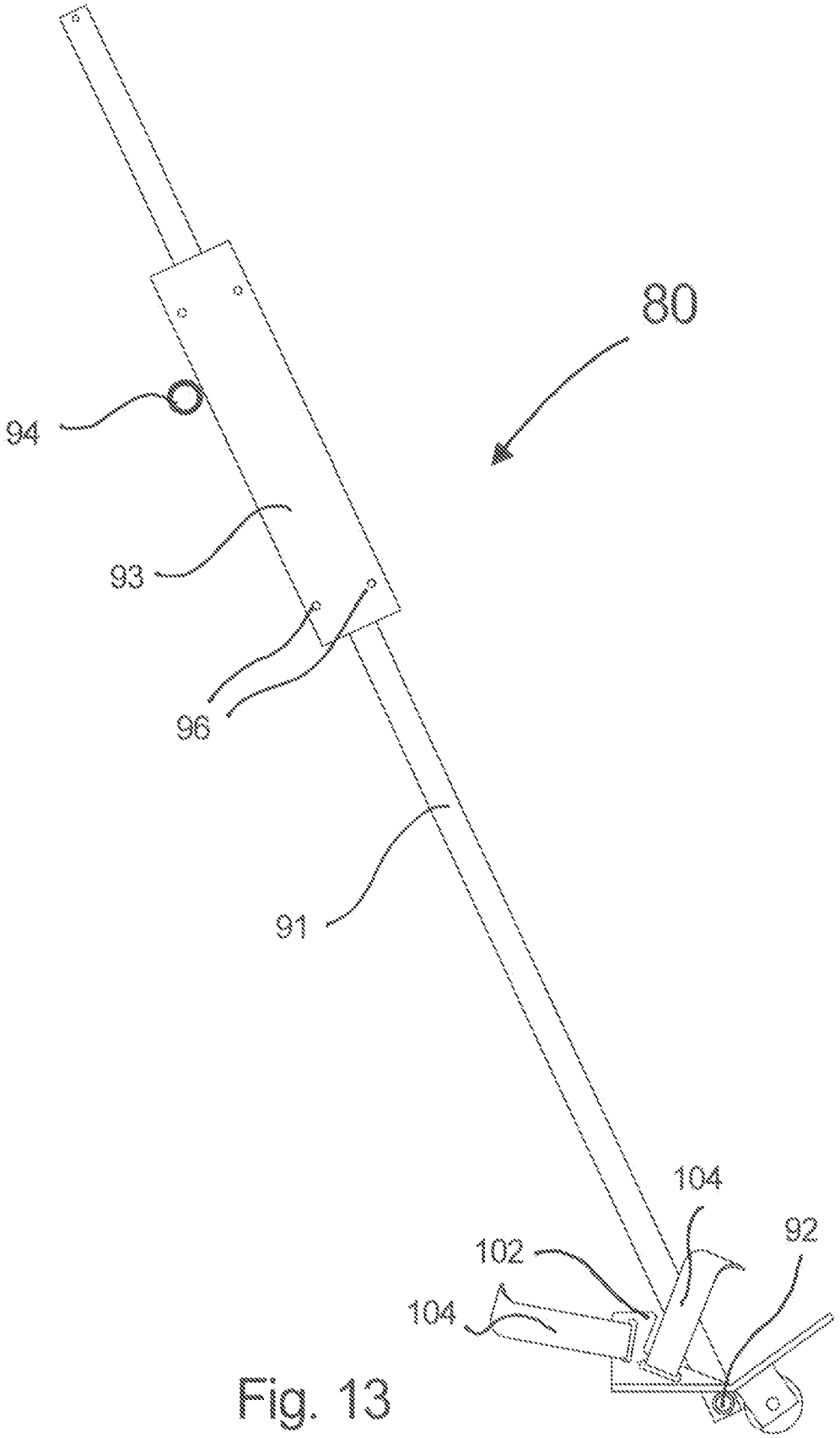
FIG. 13 is a side elevation view of the leg workout assembly according to one embodiment of the present disclosure.

The left leg workout assembly 80 as viewed in FIG. 13 has three main components including the leg extension tube 91, the leg extension carrier 93 and the foot cradle referenced with the foot cradle strap housing 102 attached to the leg extension rod 92. The foot adjustment straps 104 are attached to the foot cradle strap housing 102. Several of the ends of the ball bearing support rods 96 are visible and the leg bearing axle housing 94 is mounted on the back side of the leg bearing housing 93. There is an opposing leg workout assembly 80 mounted on the other side of the frame for the right foot as seen in FIG. 14.

A front view of the leg frame 10 is seen in FIG. 14 with the front parts of the frame removed so both leg workout assemblies 80 are more easily visible. The leg bearing axle housing 94 is mounted onto the leg axle 74 from the leg adjustment sled assembly 50 seen in FIG. 5.

Figure 15:
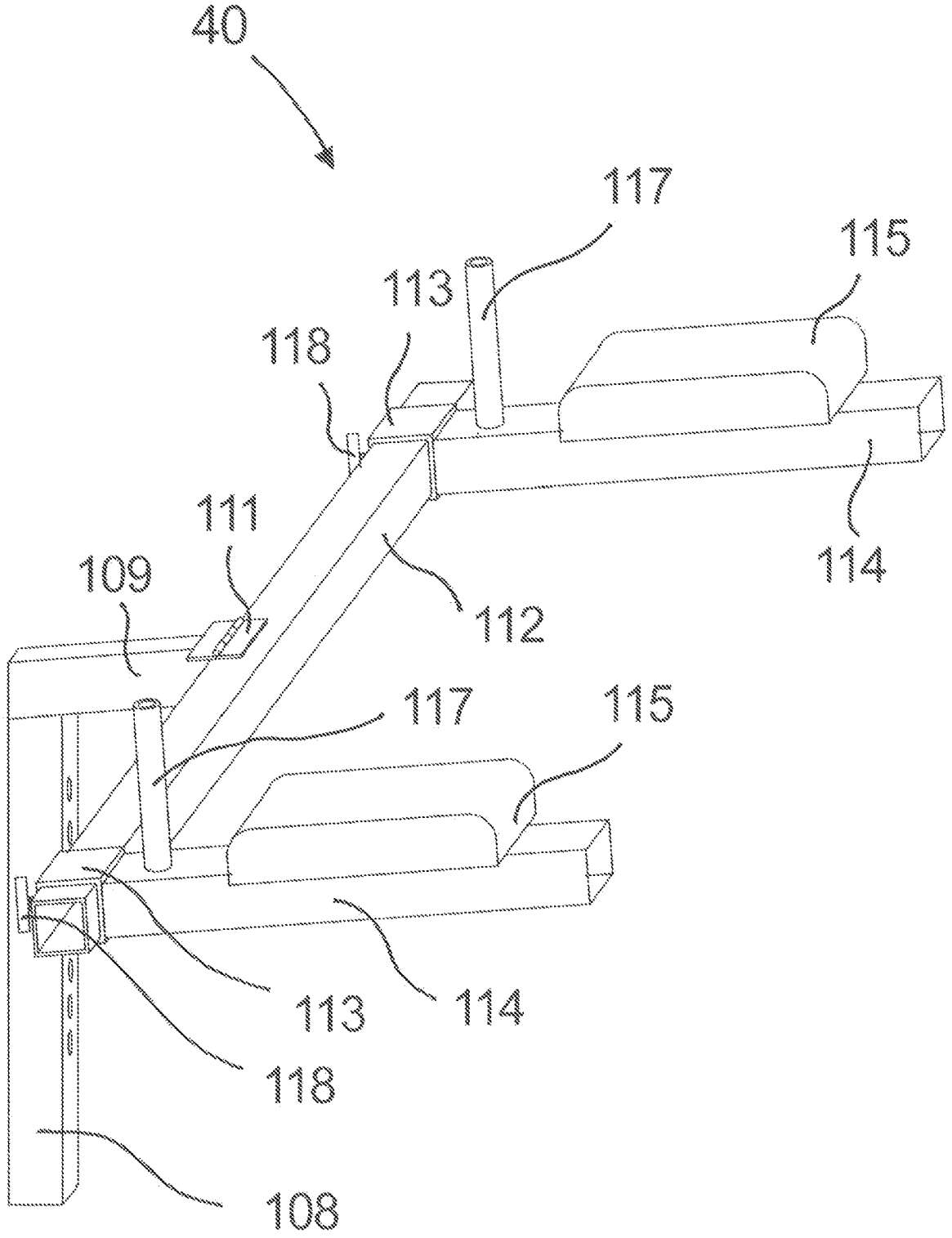
FIG. 15 is a perspective view of the arm rest assembly according to one embodiment of the present disclosure.

In FIG. 15 the arm rest assembly 40 is composed of the arm rest height adjuster 108 is slidably mounted into the arm rest adjustment sled 15 in FIG. 1 and is attached to the arm rest extension support 109. The hinge 111 is attached to the arm rest extension support 109 and width adjustment tube 112 and allows the arm rest to fold up and move out of the way for the arm workout on the combo frame 20 shown in FIG. 2. The arm rest support tubes 114 are attached to the width adjustment sleds 113 which are slidably mounted on the width adjustment tube 112 and tightened down by torque bolts 118 to allow for the adjustment of the shoulder width of the runner. While performing the leg work out, the runner must support their body weight on the arm pads 115 which cushion the forearms when the hands grasp the arm rest handles 117.

Figure 16:
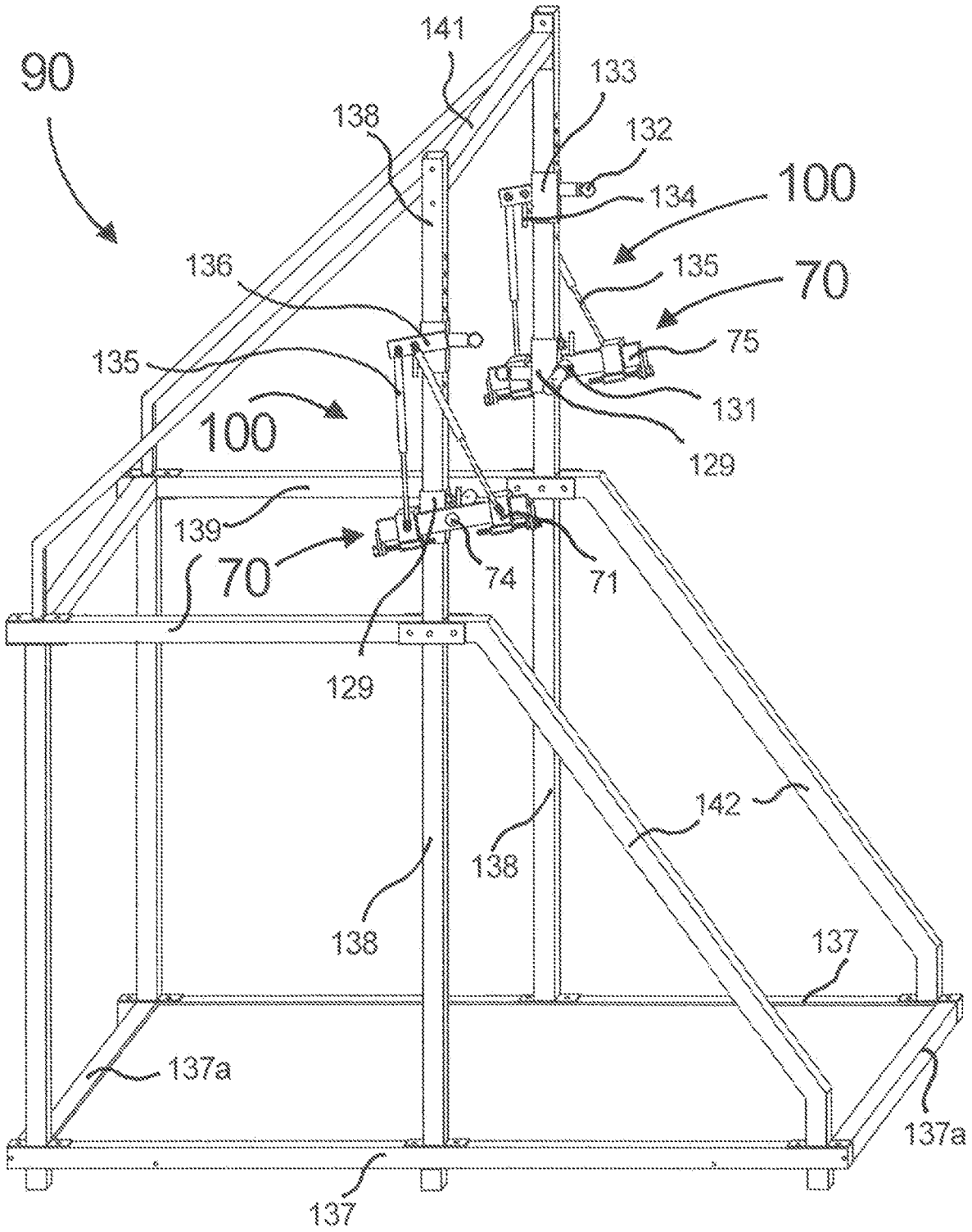
FIG. 16 is a perspective view of the arm frame featuring the arm resistance assemblies according to one embodiment of the present disclosure.

FIG. 16 features the arm workout frame 90 which has no components for the lower body work out. It consist of opposing side base rails 137 with opposing end base rails 137*a* also consisting of opposing adjustable uprights 138 attached at the bottom to the side base rail 137 in the center of the frame and attached to opposing the top rails 139 and attached laterally to the arm frame cross support 141. The top rails 139 also attach to the opposing rear angle supports 142 which also attached to the base rails 137. The arm resistance assembly 100 is slidably mounted on the adjustable uprights 138. This assembly consist of axle plate assembly 70 whose axle 74 is inserted into the axle housing tube 131 which is permanently attached to the axle plate housing sled 129. This sled has a pop pin 132 and a torque bolt 134 used to adjust the height of this assembly. The arm cylinder range sled 133 is also slidably mounted on the adjustment uprights 138 and it also has a pop pin 132 and torque bolt 134 used for cylinder range adjustment of the gas cylinders length as seen in FIG. 9 at assembly 60. The cylinder range sled 133 has a cylinder attachment plate 136 that connects to the top of the gas cylinders 135 and the bottom end of the gas cylinders are attached to the two adjustment sleds 71 slidably mounted on each axle plate 75. The axle plates assemblies 70 adjust the resistance of the gas cylinders and function identically to the leg adjustment sled assembly 50 featured in FIG. 9.

The arm resistance assembly 100 is a simpler version of leg resistance assembly 120 seen in FIG. 9. The difference is that the gas cylinders used to the arm resistance assembly 100 are much weaker and the cylinder range adjustment can be done without all the same components used the for leg resistance assembly 120. This adjustment for the cylinder range sled can be made by loosening the torque bolts 134 on the axle plate housing sled 129 and the arm cylinder range sled 133, disengage the pop pins 132 on both components, move the sleds to the appropriate setting and tighten the torque bolts 134.

Figure 17:
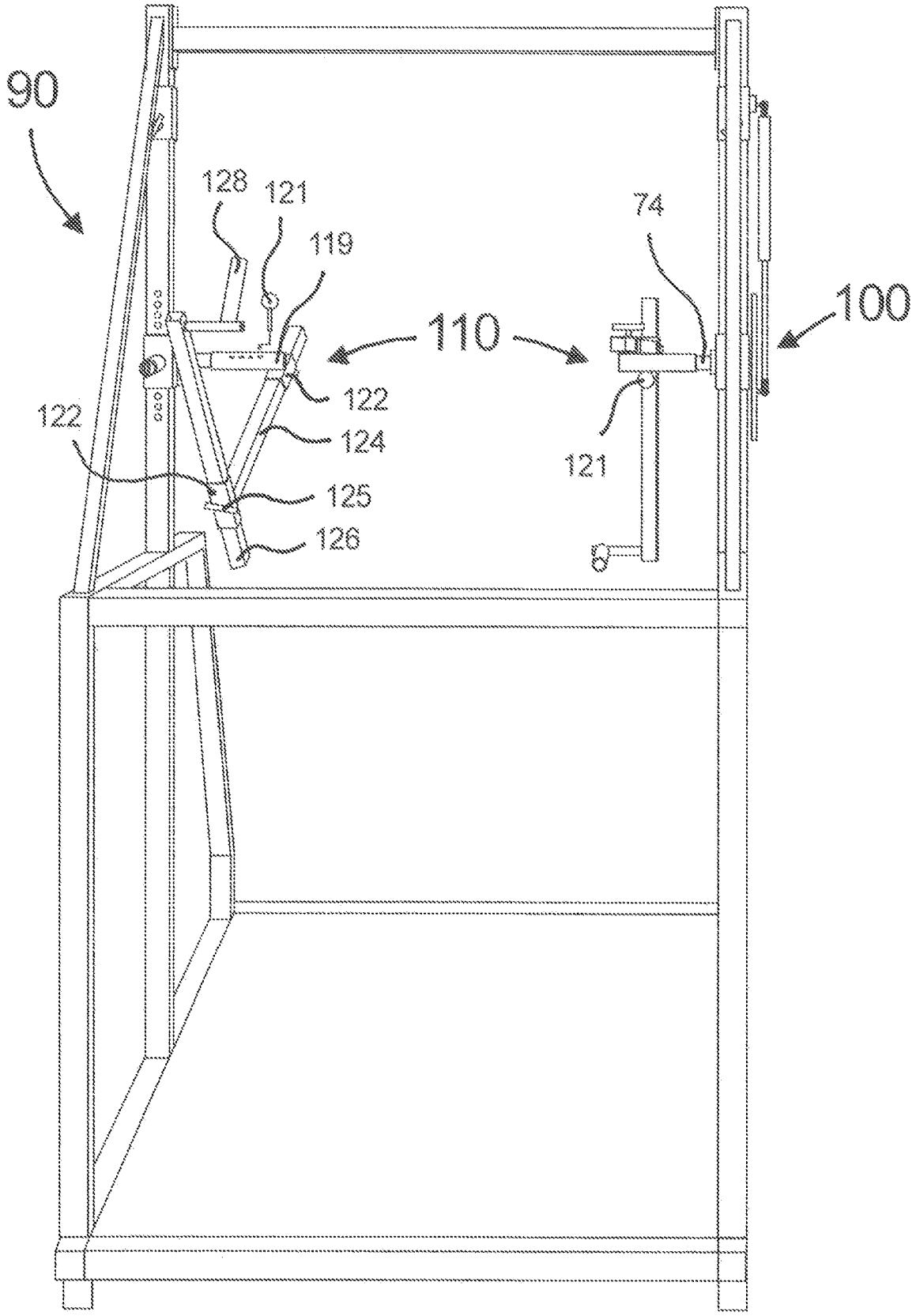
FIG. 17 is a perspective view of the front of the arm frame featuring the arm workout assemblies according to one embodiment of the present disclosure.

FIG. 17 is the arm work out frame 90 which consist of all the components from FIG. 16 including the arm resistance assembly 100 in addition to opposing arm workout assemblies 110 mounted on the inside of the arm workout uprights, which include the arm width adjuster tube 119 which has a plurality of adjustment holes used for different shoulder widths of the runner. The adjuster tube 119 is mounted on the axle 74 from the arm resistance cylinder assembly 100 with a quick release pin 121. Permanently attached to the width adjuster tube 119 is an adjustment sled 122. The humerus adjustment tube 124 adjust to the length of runner's humerus and is slidably mounted into the adjustment sled 122. On the opposite end of the humerus adjustment tube 124, there is another permanently attached adjustment sled 122. The desired adjustment for the humerus is to align the shoulder of the runner to adjustment sled 122 and the elbow of the runner to other adjustment sled attached to the bottom of the humerus adjustment tube 124. The bottom adjustment sled 122 receives the forearm adjustment tube 126 that slidably inserted into the adjustment sled 122.

The adjustment for the forearm length is made by the runner grasping the rotating handle 128, loosening the torque bolt on the adjustment sled 122, moving the forearm adjustment tube 126 until the elbow is in alignment with to adjustment sled 122 on the bottom end of the humerus adjustment tube 124 and then tighten up the torque bolt 125. When performing this work out, the goal is to keep the shoulder in alignment with the arm width adjustment tubes 119 at all times. Neither of the shoulders should move forward or backward or up and down while this work out is being done.

Figure 18:
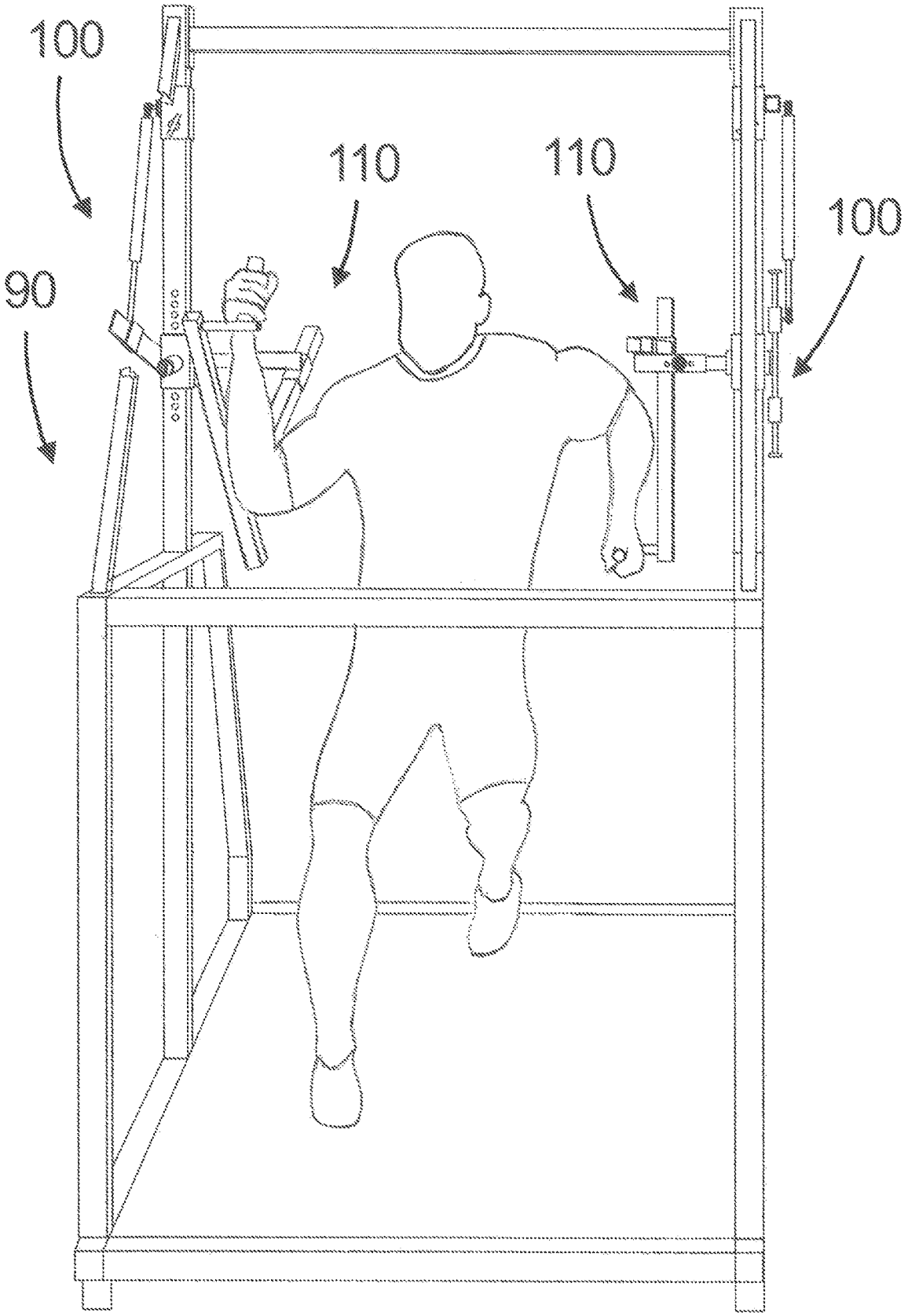
FIG. 18 is a perspective view of the front of the arm frame featuring the arm resistance assemblies, the arm workout assemblies and the runner according to one embodiment of the present disclosure.

FIG. 18 shows the arm frame 90 that consist of the arm resistance assembly 100 and the arm workout assembly 110 and the runner performing this workout. The motion on the machine is the same as the motion of an Olympic sprinter correctly moving their hands and arms back and forward without the shoulders moving off plane.

Figure 19:
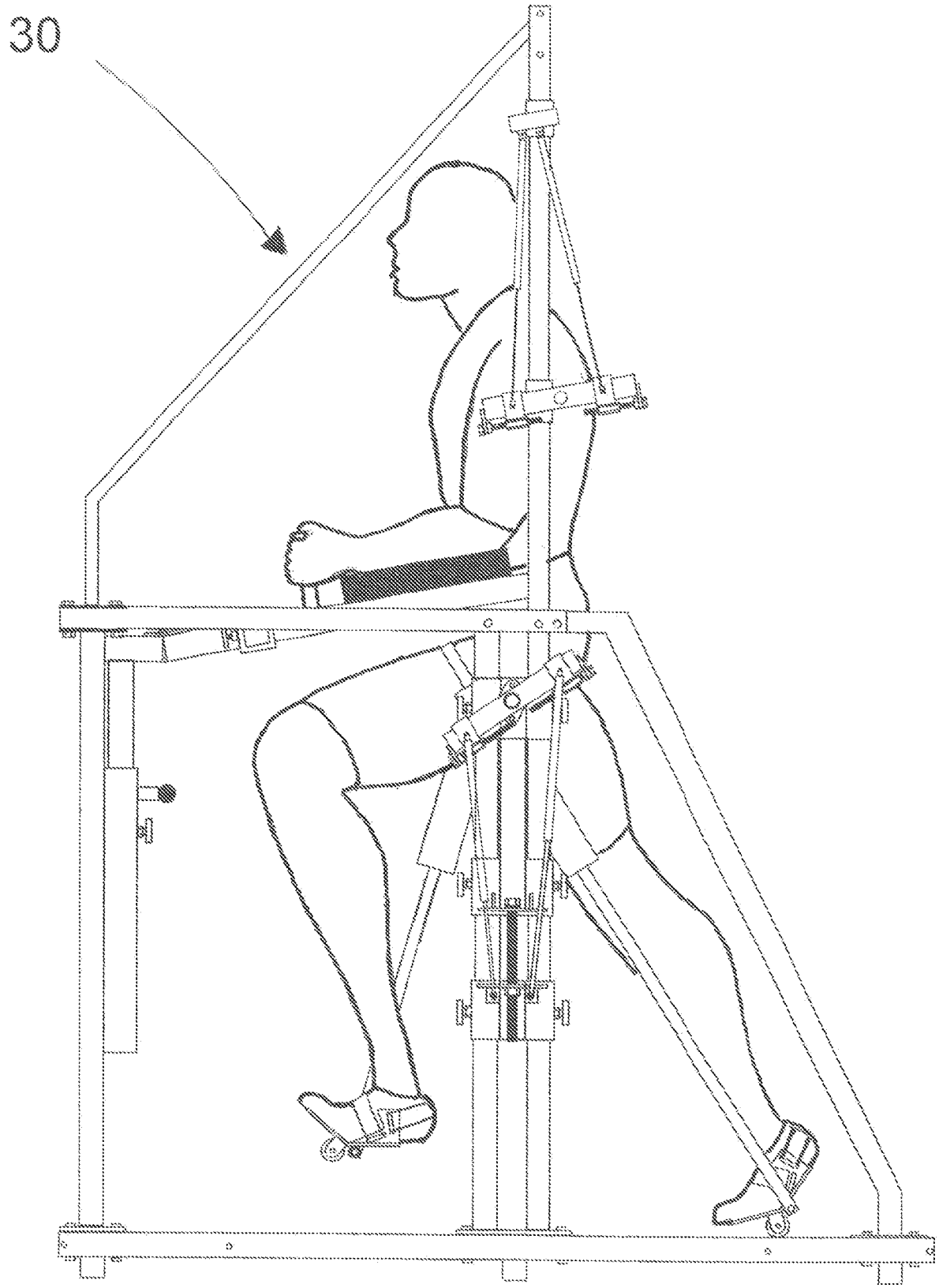
FIG. 19 is a side elevation view of the combo frame with the runner's left foot on the platform and moving backward the right leg moving forward according to one embodiment of the present disclosure.

FIG. 19 is a side elevation view of the complete combo frame 30. The left foot is in the rear of the and runner is moving backward and the right foot is moving forward.

Figure 20:
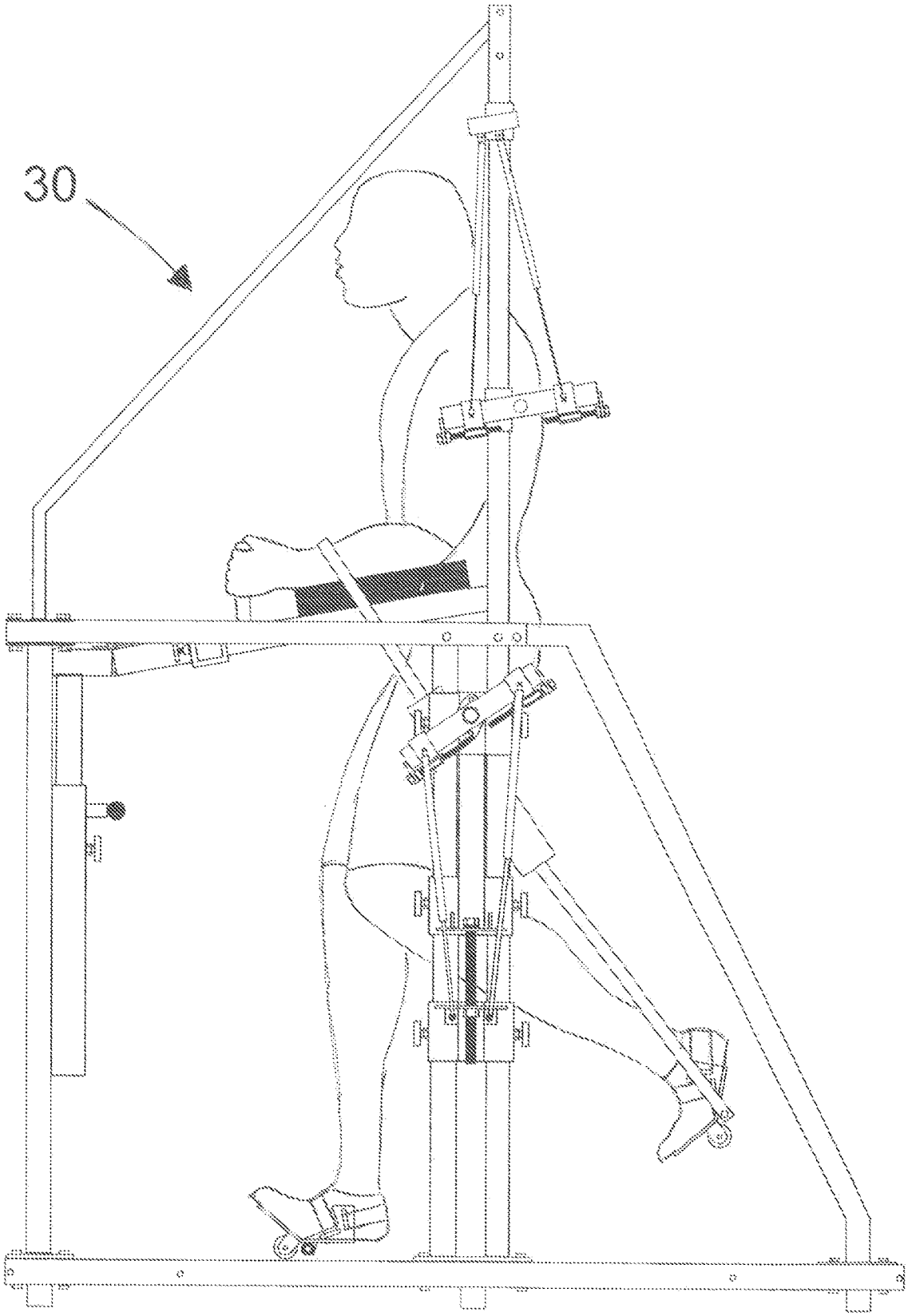
FIG. 20 is a side elevation view of the combo frame with the runners left leg moving up and forward and the right foot on the platform and moving backward according to one embodiment of the present disclosure.

FIG. 20 is a side elevation view of the complete combo frame 30. The left foot is in the rear of the runner and is moving upward and forward and the right foot has just made contact with the platform and is moving backward.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A running emulator for increasing an athlete's strength during movement of specific muscles used for running, the running emulator comprising:

a lower body frame having:

vertically positioned front upright members supporting an arm rest sled, a pair of vertical dual upright members centered on opposing sides of the lower body frame, and a platform horizontally mounted inside a base of the lower body frame;

a pair of leg resistance assemblies slidably mounted on an outside of the pair of vertical dual upright members, each of said pair of leg resistance assemblies comprising:

a leg adjustment sled support including one or more attached sleds that are slidably mounted onto a respective dual upright members for height adjustment, a bearing on said leg adjustment sled support onto which a first axle plate assembly is rotatably mounted, a leg cylinder range assembly slidably mounted on the respective dual upright members underneath the leg adjustment sled support and attached to the leg adjustment sled support with an adjustment bolt, and a pair of resistance members, each with a first end attached to the leg cylinder range assembly and a second end attached to a respective adjustment slide on the first axe plate;

a pair of leg workout assemblies pivotally mounted to a first axle protruding from the first axle plate assembly from an outside of the lower body frame to an inside of the lower body frame, each of the pair of leg workout assemblies comprising:

a leg extension carrier pivotally mounted to the first axle and arranged perpendicular to the first axe plate, an elongate leg extension tube arranged to reciprocate inside of the leg extension carrier, and a foot cradle pivotally mounted to a distal end of the elongate leg extension tube, wherein during use by an athlete the elongate leg extension tube pivots with respect to the first axle and reciprocates through the leg extension carrier such that a path travelled by the athlete's foot on the foot cradle emulates motion of a sprinter; and a hinged arm rest assembly mounted inside the arm rest sled for holding a body weight of the athlete while performing an exercise.

2. The running emulator of claim 1, wherein each of the pair of leg workout assemblies pivotally mounted on the inside of the lower body frame to the first axle of the leg resistance assembly such that a height of each first axle of the pair of leg resistance assemblies and the pair of leg workout assemblies are adjustable to a height of a hip joint of the athlete.

3. The running emulator of claim 2, wherein each of the pair of leg resistance assemblies includes the first axle plate assembly connecting the respective leg resistance assembly on the outside of the lower body frame to the respective leg workout assembly on the inside of the lower body frame such that when the athlete is moving the athlete's feet on the foot cradles, movement of the feet rotates each of the first axle plate assemblies and compresses the pair of resistance members attached to each of the pair of the leg resistance assemblies.

4. The running emulator of claim 2, wherein a position of each second end of the pair of resistance members of each of said pair of leg resistance assemblies is adjustable along the first axle plate via the respective adjustment slide to increase or decrease resistance felt by the athlete during movement of the pair of leg workout assemblies.

5. The running emulator of claim 1, further comprising:

an upper body frame having vertically centered upright members on both sides of the upper body frame, each upright member having a plurality of holes;

an arm resistance assembly slidably mounted on the outside and bottom of each of the upright members and secured to each of the upright members on at least one of the plurality of holes, the arm resistance assembly comprising:

a second axle plate assembly, an arm cylinder range assembly slidably mounted on a top of each of the upright members, and a pair of arm resistance members, each mounted on one end to the second axle plate assembly and on another end to the arm cylinder range assembly;

an arm workout assembly mounted to each of the upright members, the arm workout assembly pivotally mounted on a second axle protruding from outside of the upper body frame to inside of the upper body frame and having:

an arm width adjuster pivotally mounted on the second axle on the inside of the upper body frame, a first arm member that is slidably mounted inside an arm adjustment sled which is mounted to the arm width adjuster, a second arm member mounted at an end of the first arm member, the second arm member being distal from the second axle, and a handle located at a distal end of the second arm member, wherein during use by the athlete, the arm workout assembly pivots with respect to the upper body frame and the pair of arm resistance members resist movement of the arm workout assembly.

6. The running emulator of claim 1, wherein the pair of leg workout assemblies are vertically and adjustably mounted on the pair of dual upright members, respectively, to resist twisting of the pair of leg workout assemblies when in use during a leg workout.

7. The running emulator of claim 1, wherein, in order to further prevent twisting of the pair of leg workout assemblies and restricting movement of the pair of leg workout assemblies to a single plain corresponding to forward and backward movement of legs of the athlete, each of the leg extension carriers comprises a plurality of ball bearings positioned on all sides of an inner portion of the leg extension carrier restricting twisting of the reciprocating leg extension tube which is mounted inside the leg extension carrier.

8. The running emulator of claim 1, wherein the foot cradle of each of the pair of leg workout assemblies is pivotally mounted and swivels with respect to the elongate leg extension tube of the pair of leg workout assemblies and adjusts laterally to a width of the athlete with a collar mounted on a leg extension rod of the elongate leg extension tube.

9. A running emulator for increasing an athlete's strength during movement of muscles used for running, the running emulator comprising:

a lower body frame comprising:

vertically positioned front upright members supporting an arm rest sled, a pair of vertical dual upright members centered on sides of the lower body frame, and a platform horizontally mounted inside of a base of the lower body frame;

a pair of leg resistance assemblies slidably mounted on an outside of said pair of dual upright members, each of said pair of leg resistance assemblies comprising:

a leg adjustment sled support including one or more attached sleds that are slidably mounted onto a respective dual upright members for height adjustment, a first axle plate assembly rotatably mounted onto said leg adjustment sled support, a first cylinder range assembly slidably mounted on the respective dual upright members underneath the leg adjustment sled support and attached to the leg adjustment sled support with an adjustment bolt, and a pair of resistance members, each with one end attached to the first cylinder range assembly and the other end attached to a respective adjustment slide mounted on the first axle plate;

a pair of leg workout assemblies pivotally mounted to a first axle that protrudes from an outside of the lower body frame to an inside of the lower body frame, each of the pair of leg workout assemblies having:

a leg extension carrier pivotally mounted to the first axle and arranged perpendicular to the first axle plate, a leg extension tube reciprocating within the leg extension carrier and extending from a first end to a second end that is distal from the first end, and a foot cradle pivotally mounted to the second end of the leg extension tube, wherein during use by an athlete the leg extension tube pivots with respect to the first axle and reciprocates through the leg extension carrier such that a path travelled by a foot of the athlete on the foot cradle emulates motion of a sprinter;

a hinged arm rest assembly mounted inside the arm rest sled for holding a body weight of the athlete while performing a lower body workout;

an upper body frame having vertically centered opposing upright members on both sides of the upper body frame, each upright member including a plurality of holes;

an arm resistance assembly slidably mounted on an outside and bottom of each upright member on at least one of the plurality of holes, the arm resistance assembly comprising:

a second axle plate assembly, a second cylinder range assembly slidably mounted on a top of a respective upright member, and a pair of arm resistance members, each mounted on a first end to the second axle plate assembly and on a second end to the second cylinder range assembly;

an arm workout assembly mounted to each of the upright members, the arm workout assembly pivotally mounted to a second axle protruding from outside of the upper body frame to an inside of the upper body frame and having;

an arm width adjuster pivotally mounted on the second axle on the inside of the upper body frame, a first arm member slidably mounted inside an adjuster sled adjustably mounted to the arm width adjuster, a second arm member mounted perpendicular to the first arm member at an end of the first arm member that is distal from the second axle, and a rotatable handle boated on a distal end of the second arm member;

wherein during use by the athlete, the arm workout assembly pivots with respect to the upper body frame and the pair of arm resistance members resist movement of the arm workout assembly.

* * * * *